US007808188B2

(12) United States Patent
Po

(10) Patent No.: US 7,808,188 B2
(45) Date of Patent: Oct. 5, 2010

(54) DRIVING CIRCUIT FOR LAMP

(75) Inventor: Tai-Sheng Po, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 170 days.

(21) Appl. No.: 11/797,854

(22) Filed: May 8, 2007

(65) Prior Publication Data

US 2007/0291423 A1 Dec. 20, 2007

(30) Foreign Application Priority Data

Jun. 15, 2006 (TW) ..... 95121474 A

(51) Int. Cl.
*H05B 41/16* (2006.01)

(52) U.S. Cl. ..... 315/277; 361/18; 335/307

(58) Field of Classification Search ..... 361/1, 361/6, 13, 18, 29, 31, 45, 52, 78, 91.6, 115, 361/156, 167, 181, 182, 194, 196, 203, 205, 361/265; 335/100, 101, 171, 176, 194, 200 R, 335/209 CD, 209 R, 209 SC, 209 T, 227 R, 335/238, 239, 240, 241 R, 307, 400, 93; 318/246, 318/258, 269, 368, 380, 382, 400.09, 434, 318/443, 466, 507, 718, 759, 792, 807, 814; 315/93, 100, 101, 171, 176, 194, 200 R, 209 CD, 315/209 SC, 209 T, 227 R, 238, 239, 240, 315/241 R, 307, 400

See application file for complete search history.

(56) References Cited

U.S. PATENT DOCUMENTS

2004/0130273 A1* 7/2004 Alexandrov ..... 315/291

* cited by examiner

*Primary Examiner*—Douglas W Owens
*Assistant Examiner*—Jae K Kim

(57) ABSTRACT

A driving circuit for driving at least one lamp includes a power switching circuit, a first transformer and a feedback control circuit. The power switching circuit is electrically connected with a power source to generate an input current. The first transformer includes a primary winding and a secondary winding. The primary winding is electrically connected with the power switching circuit. The secondary winding is for transforming the input current to drive the lamp. The feedback control circuit is connected in parallel with the primary winding in order to measure a voltage variation of the primary side and output a power control signal. The power switching circuit adjusts a current for driving the lamp according to the power control signal.

11 Claims, 4 Drawing Sheets

DRIVING CIRCUIT FOR LAMP

This Non-provisional application claims priority under 35 U.S.C. §119(a) on Patent Application No(s). 095121474 filed in Taiwan, Republic of China on Jun. 15, 2006, the entire contents of which are hereby incorporated by reference.

BACKGROUND OF THE INVENTION

1. Field of Invention

The invention relates to a driving circuit, and in particular, to a lamp driving circuit.

2. Related Art

Recently, applications of flat panel displays have become increasingly popular. Among flat panel displays, the liquid crystal display (LCD) has become a mainstay of the market. With the development of liquid crystal display technology and in response to the requirements of the actual use of large scale displays, the number of lamps, e.g. cold cathode fluorescent lamps (CCFLs) serving as a backlight source, must be increased in order to provide the sufficient luminance. The prior art measures a feedback voltage of a transformer or a feedback current of the lamps to control the voltages to drive the lamps, thus ensuring the lamps' uniform light emission.

Referring to FIG. 1, a conventional lamp driving circuit 1 includes a power switching circuit 11, a transformer 12, a feedback circuit 13 and a power control circuit 14. The power switching circuit 11 receives a power PWR and generates an input current $I_{in}$. A primary side 121 of the transformer 12 is electrically connected with the power switching circuit 11 so as to transform the level of the input current $I_{in}$ and to drive a plurality of lamps 2 on a secondary side 122 of the transformer 12. The current of the lamps 2 is fed back to the feedback circuit 13 which outputs a feedback voltage $V_{FB}$. The power control circuit 14 controls a switching frequency of the power switching circuit 11 by way of pulse width modulation (PWM) according to the variation of the feedback voltage $V_{FB}$ in order to control the power switching circuit 11 to adjust the current for driving the lamps 2.

However, the feedback circuit 13 cannot individually process each current for driving the lamp 2, and can only receive the current corresponding to part of the lamps 2 as a feedback signal. Thus, the current difference between each of the lamps 2 will influence the current precision. In addition, when the lamps 2 cannot be grounded in response to the actual connection condition, the feedback circuit 13 cannot be directly connected to the lamps 2. Thus, the feedback control method of the driving circuit 1 has to be modified.

FIG. 2 shows another conventional lamp driving circuit 1A. In order to improve the drawbacks of the above-mentioned architecture, the primary side 121 of the transformer 12 may be serially connected to a primary side 151 of an induction transformer 15. A secondary side 152 of the induction transformer 15 generates the feedback voltage $V_{FB}$, which is inputted to the power control circuit 14 to control the power switching circuit 11, to adjust the current for driving the lamps 2. In addition, the output power of the transformer 12 has to be increased so as to output a sufficiently high current for driving the lamps 2. At this time, the output power of the induction transformer 15 has to be increased with the enhancement of the transformer 12 so as to withstand large currents, and the size of the induction transformer 15 also has to be enlarged. If the voltage can be directly sampled, the product can be adapted to the non-grounding, non-feedback architecture of the lamp 2, yet without the inconvenient requirements of direct current measurement of the transformer 12 and high current capacity.

Thus, it is an important subject to provide a lamp driving circuit capable of preventing the above-mentioned problems from occurring and thus obviating the above-mentioned inconvenient requirements. Thus, the voltage across two ends of the transformer for driving the lamps can be directly measured, and the feedback control efficiency can be enhanced.

SUMMARY OF THE INVENTION

In view of the foregoing, the invention is to provide a driving circuit capable of directly measuring a voltage across two ends.

To achieve the above, the invention discloses a driving circuit for driving at least one lamp. The driving circuit includes a power switching circuit, a first transformer and a feedback control circuit. The power switching circuit is electrically connected with a power source to generate an input current. The first transformer includes a primary side having a primary winding and being electrically connected with the power switching circuit, and a secondary side having a secondary winding for transforming the input current to drive the lamp. The feedback control circuit is connected in parallel to the primary winding to measure a voltage variation of the primary side and output a power control signal. The power switching circuit adjusts a current for driving the lamp according to the power control signal.

To achieve the above, the invention also discloses a driving circuit for driving at least one lamp which includes a power switching circuit, a transformer, a voltage transforming circuit and a power control circuit. The power switching circuit is electrically connected with a power source to generate an input current. The transformer includes a primary side having a primary winding and being electrically connected with the power switching circuit, and a secondary side having a secondary winding for transforming the input current to drive the lamp. The voltage transforming circuit is connected in parallel to the primary winding to measure a voltage variation of the primary side and output a feedback voltage. The power control circuit is electrically connected with the voltage transforming circuit to receive the feedback voltage and output a power control signal. The power switching circuit adjusts a current for driving the lamp according to the power control signal.

As mentioned above, the feedback control circuit and the transformer for driving the lamps are connected in parallel to each other, or the voltage transforming circuit and the transformer for driving the lamps are connected in parallel to each other in the lamp driving circuit according to the invention. Thus, the voltage across the two ends of the transformer can be directly measured so that the feedback control efficiency can be enhanced.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
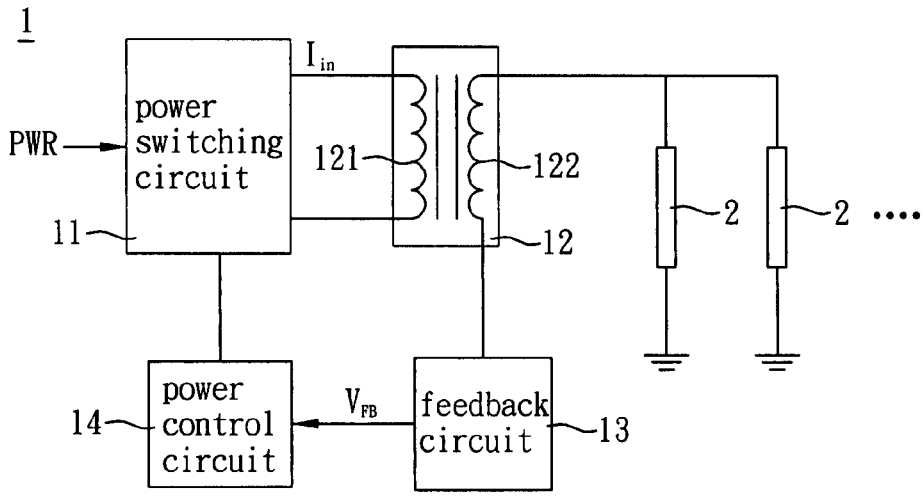
FIG. 1(PRIOR ART)
FIGS. 1 and 2 are schematic illustrations showing conventional lamp driving circuits.
Figure 2:
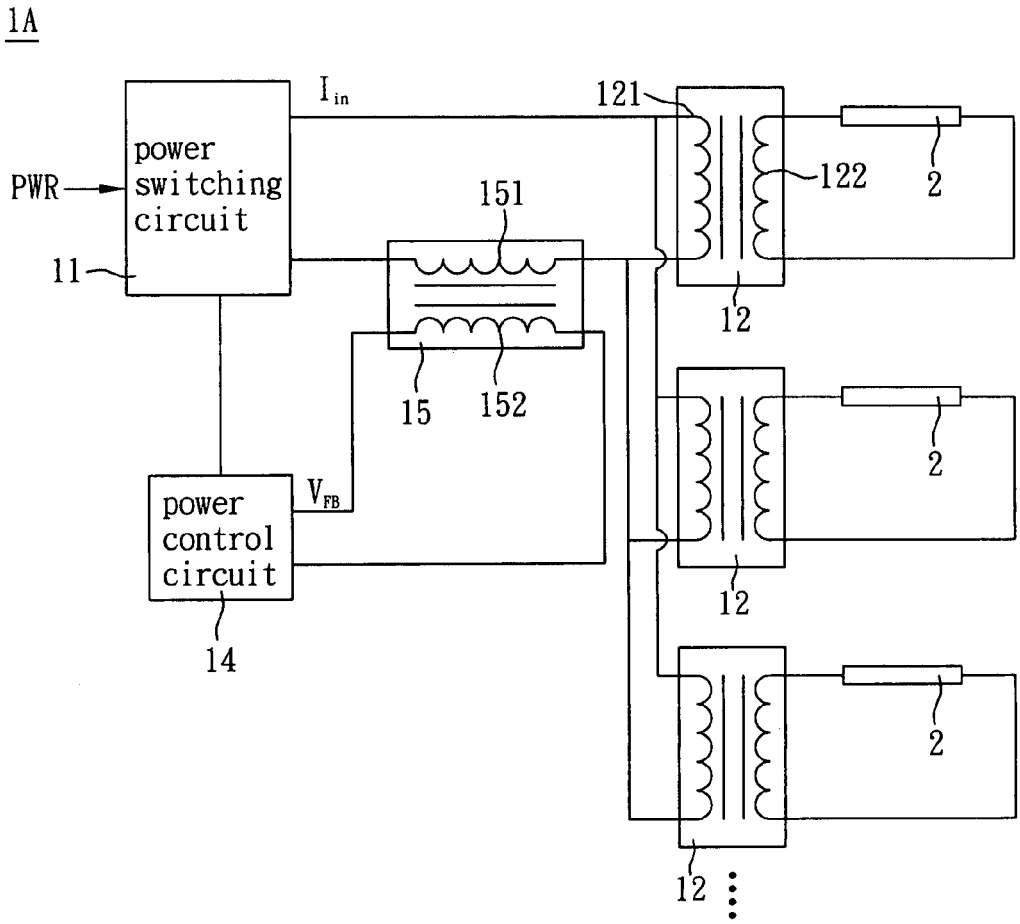
FIG. 2(PRIOR ART)
Figure 3:
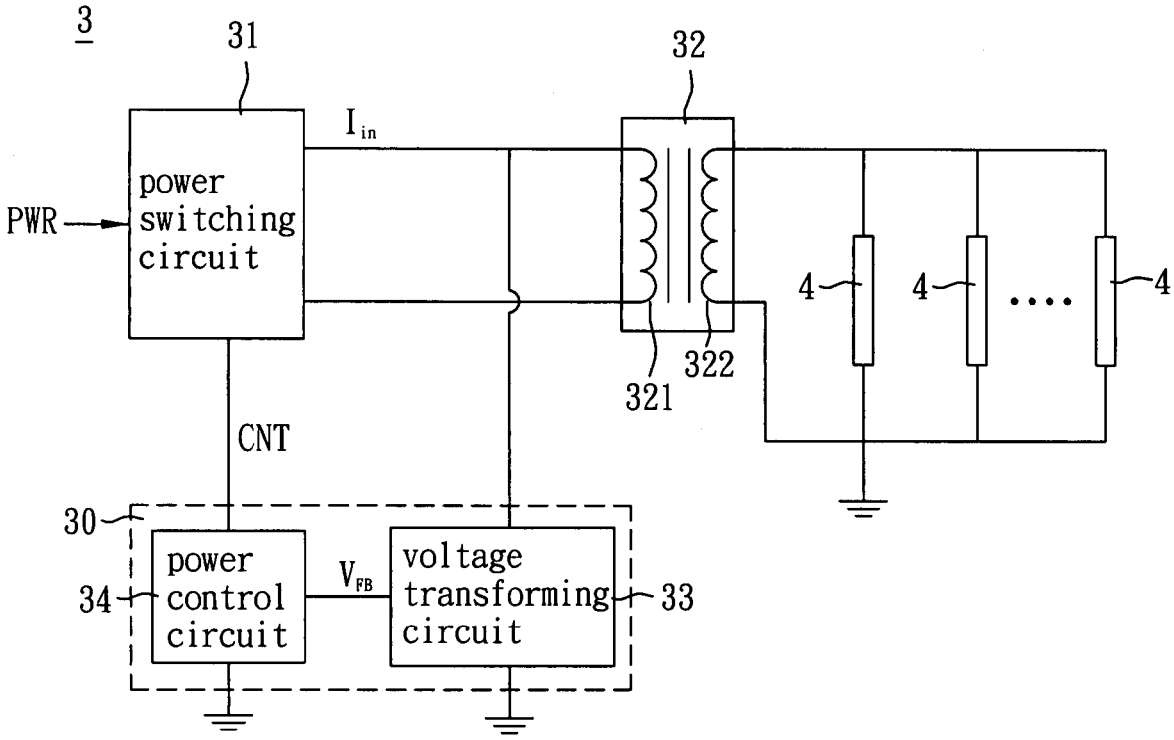
FIG. 3 is a schematic illustration showing a lamp driving circuit according to an embodiment of the invention.

Referring to FIG. 3, a driving circuit 3 for driving at least one lamp 4 according to an embodiment of the invention includes a power switching circuit 31, a transformer 32 and a feedback control circuit 30. The transformer 32 includes a primary side and a secondary side. The primary side of the transformer 32 has a primary winding 321, and the secondary side of the transformer 32 has a secondary winding 322. In this embodiment, the driving circuit 3 drives a plurality of lamps 4. If the driving circuit 3 is applied to a backlight module, the lamp will be a cold cathode fluorescent lamp. The power switching circuit 31 is electrically connected with a power PWR to generate an input current $I_{in}$. The primary winding 321 is electrically connected with the power switching circuit 31. The secondary winding 322 converts the input current $I_{in}$ to drive the lamps 4. The current outputted by the secondary winding 322 is controlled by the power switching circuit 31. The winding number of turns between the primary winding 321 and the secondary winding 322 is directly proportional to the voltage and inversely proportional to the current.

The feedback control circuit 30 has a terminal connected between the power switching circuit 31 and the primary winding 321 and is used to measure the voltage variation of the primary side, i.e. the primary winding 321, and thus output a power control signal CNT. The power switching circuit 31 adjusts a total current for driving the lamps 4 according to the power control signal CNT.

In this embodiment, the feedback control circuit 30 includes a voltage transforming circuit 33 and a power control circuit 34. The voltage transforming circuit 33 has a terminal connected between the power switching circuit 31 and the primary winding 321 and is used to measure the voltage of the primary side (primary winding 321) and output a feedback voltage $V_{FB}$. Because the primary winding 321 can respond to the current variation of the secondary winding 322 and the current flowing through the secondary winding 322 is the total current for driving the lamps 4, the feedback voltage $V_{FB}$ can also respond to the total current.

The power control circuit 34 is electrically connected with the voltage transforming circuit 33 to receive the feedback voltage $V_{FB}$ and output the power control signal CNT which can be a pulse width modulation (PWM) signal. The power switching circuit 31 adjusts the total current for driving the lamps 4 according to the power control signal CNT.

Compared with the prior art, the voltage transforming circuit 33 measures the voltage of the primary side of the transformer 32 but does not measure the current of the primary side or a feedback current of the lamps 4. Thus, in contrast with the prior art, it is unnecessary to increase the output power of the voltage transforming circuit 33 due to the influence of high current. In addition, because the feedback signal itself is presented in the form of voltage, the voltage transforming circuit 33 does not have to perform the current-to-voltage transformation. Thus, the distortion generated during the signal transformation can be avoided.

Figure 4:
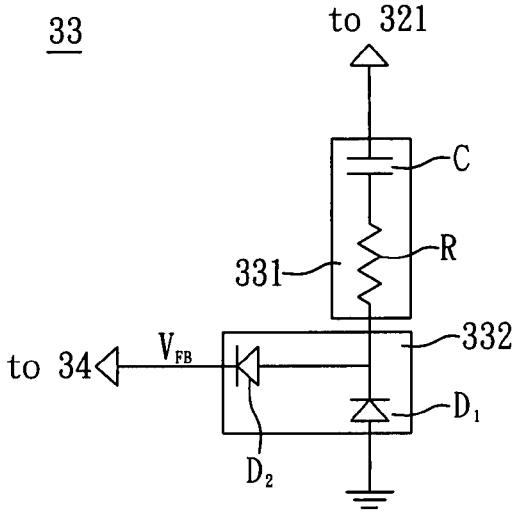
FIG. 4 is a schematic illustration showing a voltage transforming circuit according to the embodiment of the invention.

Referring to FIG. 4, the voltage transforming circuit 33 of this embodiment includes a voltage stabilizer 332 and a filter 331. The voltage stabilizer 332 includes a first diode $D_1$ and a second diode $D_2$, and the filter 331 includes a capacitor C and a resistor R.

First ends of the resistor R and the capacitor C are electrically connected with each other, and a second end of the capacitor C is electrically connected with the primary winding 321. Thus, the overall voltage transforming circuit 33 and the primary winding 321 are connected in parallel in order to measure the voltage of the primary side (primary winding 321). Also, in the voltage transforming circuit 33, the resistor R mainly serves as a load, which is serially connected to the second diode $D_2$ to output the feedback voltage $V_{FB}$. The capacitor C filters the feedback voltage $V_{FB}$ to prevent a pulse from being inputted to the power control circuit 34. The first diode $D_1$ is backward connected with and between a ground and the resistor. R of the filter 331, and the second diode $D_2$ is forward connected with and between the resistor R of the filter 331 and the power control circuit 34 in order to prevent the current from flowing backward to the primary winding 321 of the transformer 32. The power control circuit 34 receives the feedback voltage $V_{FB}$ to perform the feedback control in order to adjust the current for driving the lamps 4.

Figure 5:
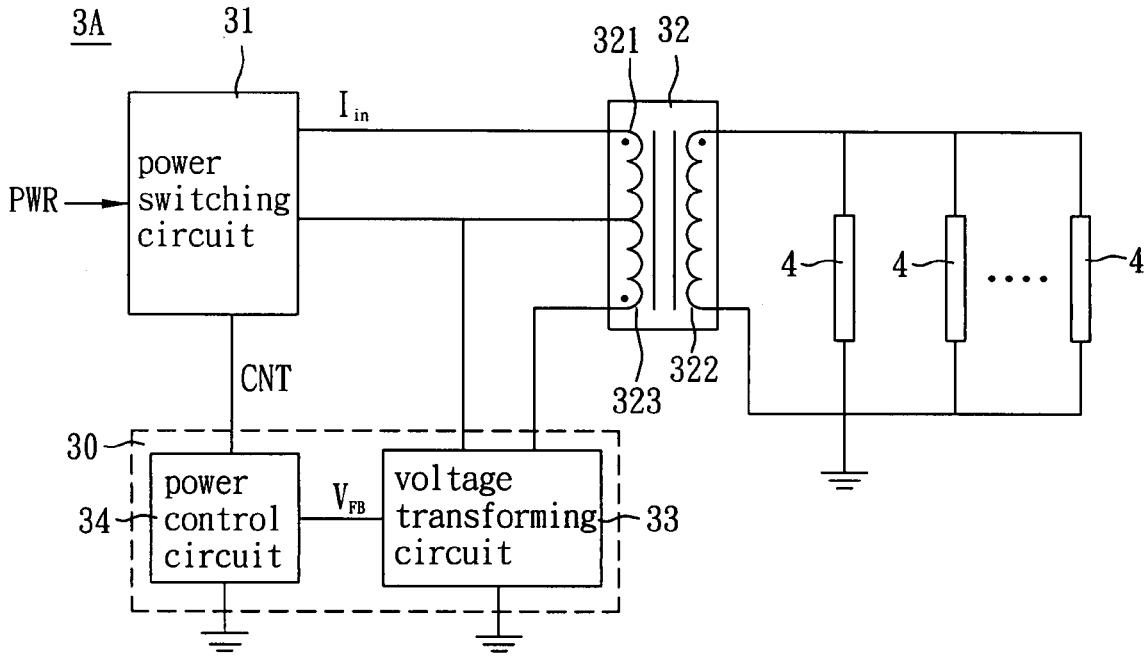
FIGS. 5 to 7 are schematic illustrations showing lamp driving circuits according to different embodiments of the invention.

Referring to FIG. 5, in a driving circuit 3A, the primary side of the transformer 32 further has an induction winding 323. The voltage transforming circuit 33 is connected in parallel to the induction winding 323 to measure the voltage of the primary side (induction winding 323) and output the feedback voltage $V_{FB}$. The voltage transforming circuit 33 is shown in FIG. 4. The capacitor C is electrically connected with the induction winding 323 but not the primary winding 321. The second diode $D_2$ prevents the current from flowing backward to the induction winding 323 of the transformer 32.

The induction winding 323 and the primary winding 321 are commonly wound. The induction winding 323 may be wound inside the primary winding 321, or the primary winding 321 may be wound inside the induction winding 323. The induction winding 323 can induce a voltage having the same phase and the same variation ratio as those of the voltage of the primary winding 321. The primary winding 321 and the induction winding 323 can be wound by one conductive wire or two conductive wires. If the primary winding 321 and the induction winding 323 are wound with the same number of turns, the voltage across two ends of the induction winding 323 will be the same as that across two ends of the primary winding 321. If the primary winding 321 and the induction winding 323 ares would with unequal numbers of turns, a ratio of the voltage across the two ends of the induction winding 323 to the voltage across the two ends of the primary winding 321 will be constant. The voltage across the two ends of the induction winding 323 responds with the current to drive the lamps 4.

Figure 6:
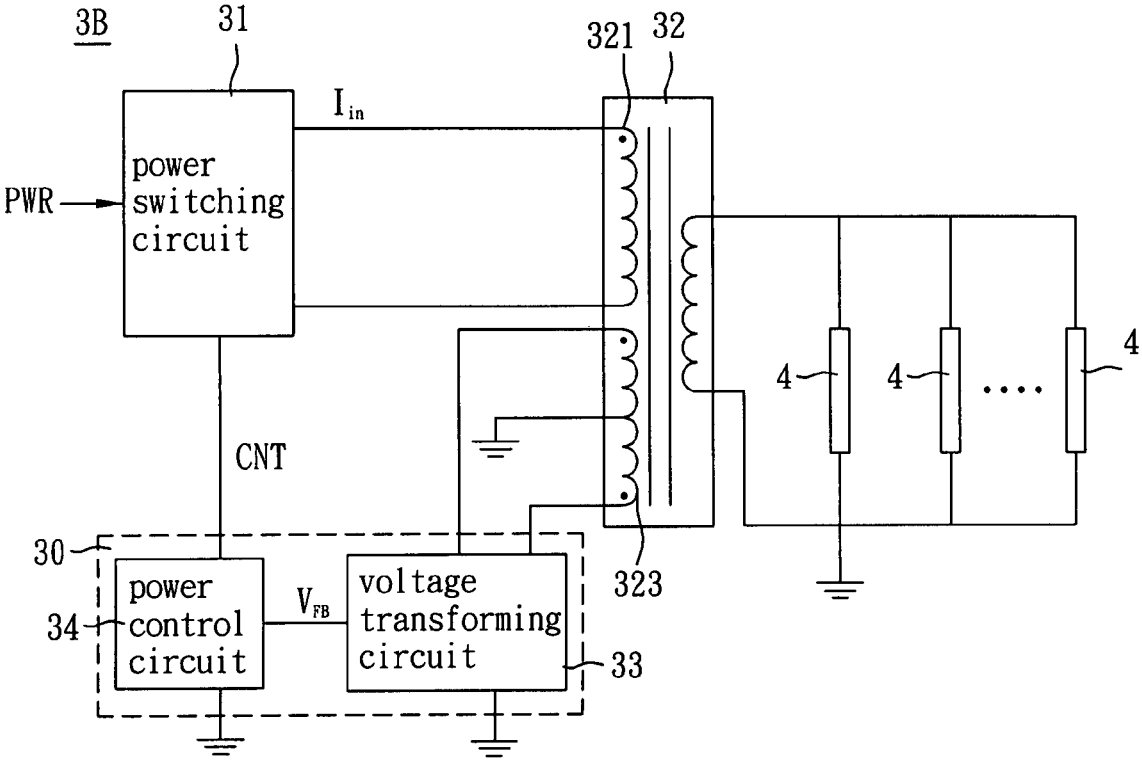

In addition, a driving circuit 3B shown in FIG. 6 differs from that of FIG. 5 in that the primary side of the transformer 32 has a primary winding 321 and two induction windings 323. The induction windings 323 are commonly wound. The induction windings 323 can induce the voltage having the same phase and the same variation ratio as the voltage of the primary winding 321 through the secondary winding 322. The voltage transforming circuit 33 is connected in parallel to the induction windings 323 in order to measure the voltage of the primary side (the induction windings 323) and output the feedback voltage $V_{FB}$.

Figure 7:
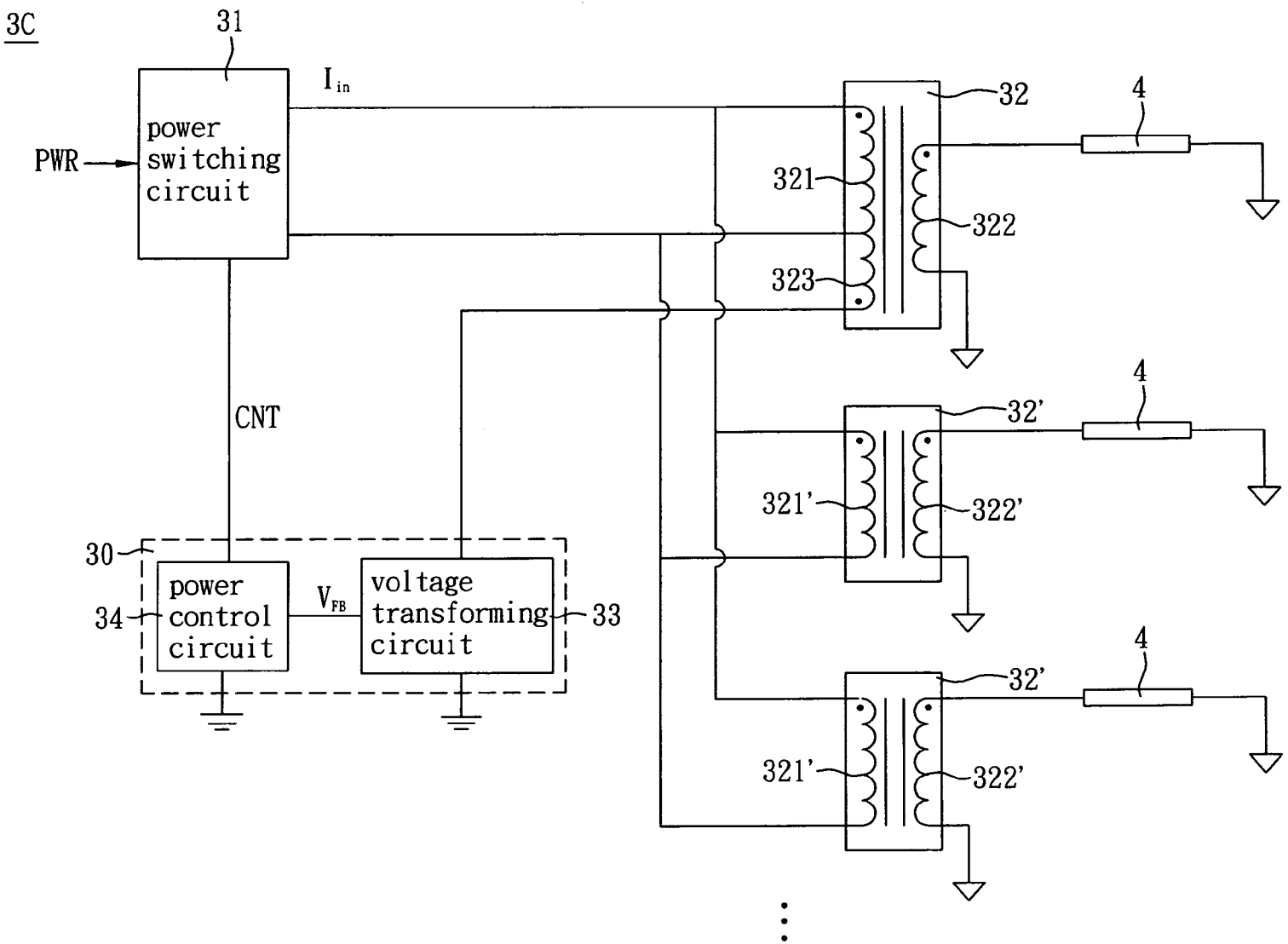

Furthermore, a driving circuit 3C shown in FIG. 7 differs from the embodiment of FIG. 5 in that the driving circuit 3 further includes a plurality of transformers 32' each having a primary side and a secondary side. The primary side of each transformer 32' has a primary winding 321'. The secondary side of each transformer 32' has a secondary winding 322'. The transformers 32 and 32' are connected in parallel and electrically connected with the power switching circuit 31, and the secondary winding 322' of each transformer 32' is electrically connected with at least one of the lamps 4. The driving circuit 3C can be individually connected with one transformer, and also be simultaneously connected with a plurality of transformers in order to drive a plurality of lamps.

According to the above-mentioned embodiments, the voltage transforming circuit 33 can be applied to various driving architectures and can measure the voltage of the primary side of the transformer 32 or 32' so as to detect the current driving the lamps 4 for the purpose of feedback control.

In summary, the feedback control circuit and the transformer for driving the lamps are connected to each other, or the voltage transforming circuit and the transformer for driving the lamps are connected to each other in the lamp driving circuit according to the invention. Thus, the voltage across the two ends of the transformer can be directly measured so that the feedback control efficiency can be enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving circuit for driving at least one lamp, comprising:

a power switching circuit connected with a power source to generate an input current;

a first transformer connected between the power switching circuit and the lamp and having a primary winding connected with the power switching circuit, a secondary winding for transforming the input current to drive the lamp, and at least one induction winding for inducing a voltage in response to a current which drives the lamp; and a feedback control circuit having a terminal connected to the induction winding so as to measure a voltage variation of the primary winding through the induction winding and output a power control signal, wherein the power switching circuit adjusts the current for driving the lamp according to the power control signal, wherein the feedback control circuit comprises: a voltage transforming circuit connected to the primary winding of the first transformer to measure the voltage variation and output a feedback voltage; and a power control circuit connected with the voltage transforming circuit to receive the feedback voltage and output the power control signal, wherein the power switching circuit adjusts the current for driving the lamp according to the power control signal; wherein the voltage transforming circuit comprises a filter connected with the primary winding; wherein the filter comprises: a capacitor having one terminal connected with the primary winding; and a resistor connected with the other terminal of the capacitor; wherein the voltage transforming circuit further comprises a voltage stabilizer connected with the filter; wherein the voltage stabilizer comprises: a first diode backward connected with and between a ground and the filter; and a second diode forward connected with the filter.

2. The driving circuit according to claim 1, wherein the induction winding induces the voltage having the same phase and the same variation ratio as those of a voltage of the primary winding.

3. The driving circuit according to claim 2, wherein the primary winding has a plurality of induction windings commonly wound.

4. The driving circuit according to claim 2, wherein the voltage transforming circuit is connected in parallel to the induction winding.

5. The driving circuit according to claim 1, further comprising:

at least one second transformer having a primary winding and a secondary winding for transforming the input current to correspondingly drive another lamp, wherein the primary winding is electrically connected with the power switching circuit.

6. The driving circuit according to claim 1, wherein the lamp is a cold cathode fluorescent lamp (CCFL).

7. A driving circuit for driving at least one lamp, the driving circuit comprising:

a power switching circuit connected with a power source to generate an input current;

a first transformer connected between the power switching circuit and the lamp and having a primary winding connected with the power switching circuit, a second winding for transforming the input current to drive the lamp, and at least one induction winding for inducing a voltage in response to a current which drives the lamp;

a voltage transforming circuit having a terminal connected to the induction winding so as to measure a voltage variation of the primary winding through the induction winding and output a feedback voltage; and a power control circuit connected with the voltage transforming circuit to receive the feedback voltage and output a power control signal, wherein the power switching circuit adjusts the current for driving the lamp according to the power control signal, wherein the voltage transforming circuit comprises a filter connected with the primary winding; wherein the filter comprises: a capacitor having one terminal connected with the primary winding; and a resistor connected with the other terminal of the capacitor; wherein the voltage transforming circuit further comprises a voltage stabilizer connected with the filter; wherein the voltage stabilizer comprises: a first diode backward connected with and between a ground and the filter; and a second diode forward connected with the filter.

8. The driving circuit according to claim 7, wherein the induction winding induces the voltage having the same phase and the same variation ratio as those of a voltage of the primary winding.

9. The driving circuit according to claim 8, wherein the primary winding has a plurality of induction windings commonly wound.

10. The driving circuit according to claim 8, wherein the voltage transforming circuit is connected in parallel to the induction winding.

11. The driving circuit according to claim 7, further comprising:

at least one second transformer having a primary winding and a secondary winding for transforming the input current to correspondingly drive another lamp, wherein the primary side is electrically connected with the power switching circuit.

* * * * *